United States Patent [19]

Murphy

[11] Patent Number: 4,603,513

[45] Date of Patent: Aug. 5, 1986

[54] MOTOR DRIVEN FEED SHARPENER

[76] Inventor: Charles J. Murphy, R.R. #4, Abilene, Kans. 67410

[21] Appl. No.: 675,957

[22] Filed: Nov. 28, 1984

[51] Int. Cl.[4] ..... B24B 3/36

[52] U.S. Cl. ..... 51/250

[58] Field of Search ..... 51/250, 246; 76/82.1; 56/250

[56] References Cited

U.S. PATENT DOCUMENTS 4,031,670 6/1977 Murphy ..... 51/250

4,246,729 1/1981 Murphy ..... 51/250

FOREIGN PATENT DOCUMENTS 3332559 5/1984 Fed. Rep. of Germany ..... 51/250

*Primary Examiner*—Roscoe V. Parker

*Attorney, Agent, or Firm*—Edwin H. Crabtree

[57] ABSTRACT

A motor driven feed sharpener for raising and lowering a sharpening stone on a feed chopper. When the sharpening stone is lowered a cover plate opens and the sharpening stone engages the top of rotating feed chopping knives and sharpens the feed chopping knives as they are rotated thereby. When the sharpening stone is raised into the feed sharpener, a cover plate is automatically moved to close the opening between the sharpening stone and the knives to contain the chopped material within the feed chopping knife cylinder and to protect the sharpening stone from abrasion during normal feed chopping.

6 Claims, 7 Drawing Figures

MOTOR DRIVEN FEED SHARPENER

BACKGROUND OF THE INVENTION

This invention relates to a feed sharpener for sharpening feed chopping knives and more particularly but not by way of limitation to a motor driven feed sharpener for automatically lowering a sharpening stone and engaging feed chopping knives and sharpening the knives as they are rotated past the stone.

Heretofore there have been various types of adjustable sharpeners for sharpening feed chopping knives along with various types of sharpeners used with lawn mowers and other kinds of cutting blades. In particular, the applicant has invented adjustable sharpeners described in U.S. Pat. Nos. 4,031,670 and 4,246,729. The subject invention eliminates the need of having to manually adjust a feed sharpening stone in an up and down direction toward the axis of a cutter head with feed chopping knives which is now done automatically by the subject invention.

SUMMARY OF THE INVENTION

The subject motor driven feed sharpener is activated by a motor drive which automatically lowers and raises a sharpening stone for engaging and sharpening a plurality of feed sharpening knives.

The feed sharpener further includes a slidable cover plate which covers an opening used for lowering the sharpening stone to engage the feed chopping knives. When the motor is activated the stone is automatically lowered and at the same time the cover plate is moved away from the opening so the stone can be lowered on top of the rotating feed chopping knives.

The motor driven feed sharpener for sharpening feed chopping knives and the like includes a drive motor connected to a drive shaft. The motor is mounted on top of a sharpener housing. A stoneholder shaft is connected to the drive shaft and rotated thereby. The stoneholder shaft is disposed in the top of the stone holder and includes a cam mounted thereon. A stoneholder is slidably mounted in the sharpener housing. The stoneholder has an elongated sharpening stone mounted on the bottom thereof. The cam engages the stone holder for raising and lowering the holder in the sharpener housing when the drive motor is activated. A mounting plate is disposed above the feed chopping knives. The mounting plate receives the sharpener housing thereon. The mounting plates include an elongated opening therein for receiving the bottom of the stone when a cover plate is slidably moved away from the opening. The cover plate is moved away from the opening as the stone is lowered. As the stone is raised, the cover plate is moved toward the opening and covers the opening when the stone reaches its raised height in the sharpener housing.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
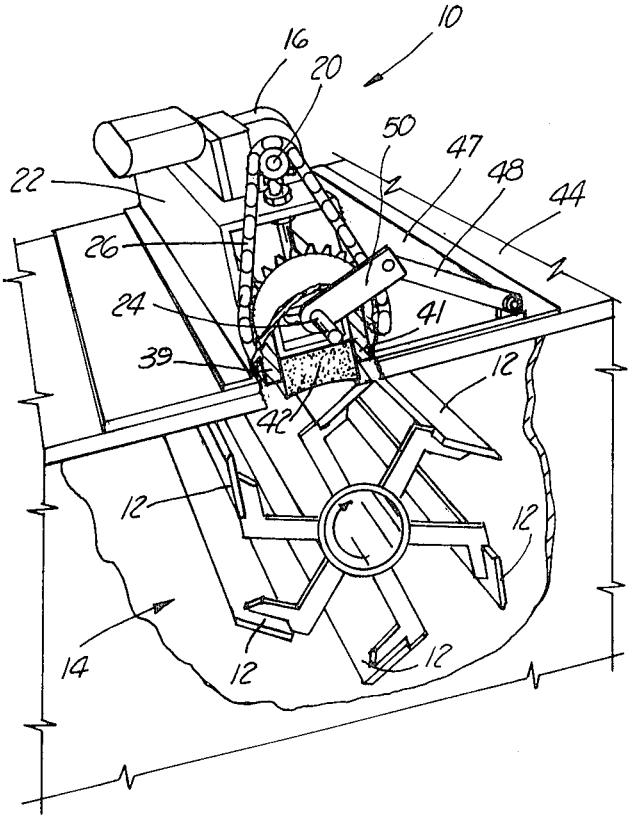
FIG. 1 illustrates a perspective view of the motor driven feed sharpener mounted above the feed chopper knives.

In FIG. 1 the motor driven feed sharpener is designated by general reference numeral 10. The sharpener 10 is disposed above a plurality of feed chopping knives 12 mounted on a rotating cutter head 14. The feed sharpener 10 includes a drive motor 16 connected to a drive shaft 20. The motor 16 is mounted on top of a sharpener housing 22. A stoneholder shaft 24 is connected to the drive shaft 20 by an endless chain 26 and rotated thereby. The motor 16 may be electric, hydraulic or air operated.

Figure 2:
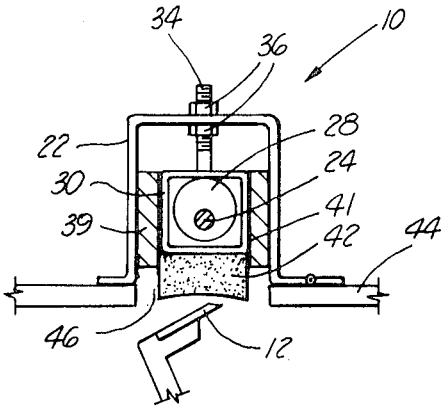
FIG. 2 and FIG. 3 illustrate and end view of the motor driven feed sharpener with the stone holder and elongated sharpening stone in a raised position and a lowered position.
Figure 3:
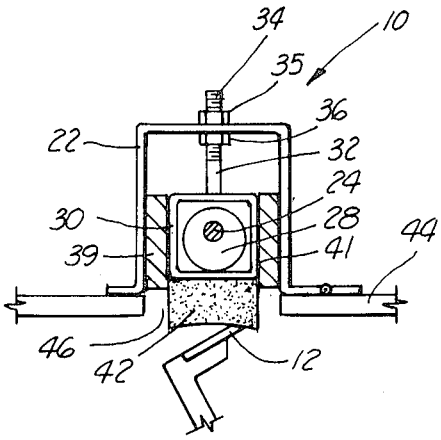
Figure 4:
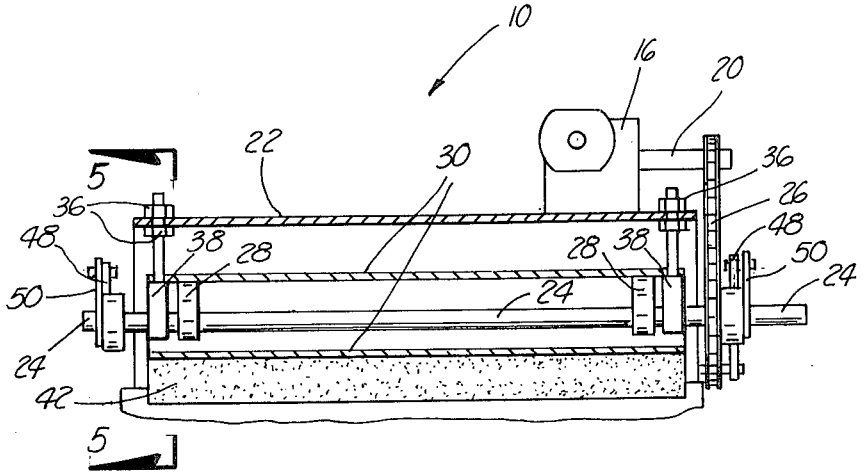
FIG. 4 illustrates a side sectional view of the sharpener.

Referring now to FIGS. 2, 3 and 4 the stoneholder shaft 24 includes cams 28 mounted thereon. A tubular stoneholder 30 is slidably mounted in the sharpener housing 22 through the use of a plurality of depth adjusting bolts 32 having a threaded end portion 34 which is secured to the top of the sharpener housing 22 by adjusting nuts 36. The lower end of the bolts 36 include a shaft bearing 38 having an elongated bearing surface 40 therein for receiving the stoneholder shaft 24. The elongated bearing surface 40 is necessary to allow horizontal movement of stoneholder shaft 24 to permit raising and lowering of stoneholder 30 within the confined space. The bearing 38 can be seen in FIG. 5.

The cam 28 is received in the tubular stoneholder 30 for raising and lowering the stoneholder 30 in the sharpeners housing 22. Mounted on the bottom of the stoneholder 30 and secured by a pair or stoneholder plates 39 and 41 is an elongated sharpening stone 42. The cam 28 when rotated, raises the stoneholder 30 and the stone 42 away from knives 12 as shown in FIG. 2. When the cam 28 is rotated downwardly approximately 180°, the stoneholder 30 and the stone 42 are lowered for engaging and sharpening the knives 12.

A mounting plate 44 is disposed above the feed chopping knives 12 with the mounting plate 44 receiving the sharpener housing 22 thereon. The mounting plate 44 has an elongated opening 46 therein for receiving the bottom of the stone 42 when the stoneholder 30 is lowered by the cam 28.

Figure 5:
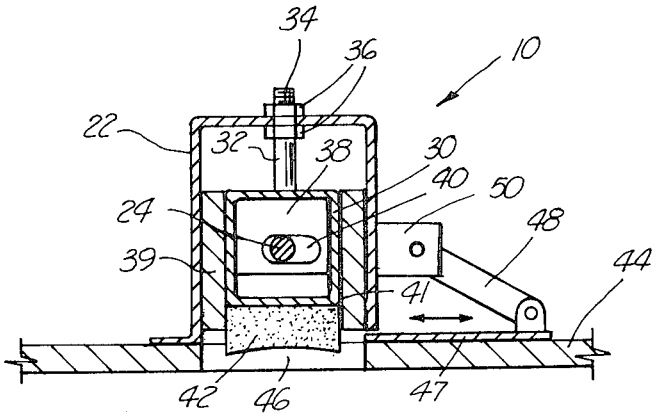
FIG. 5 illustrates and end view taken along lines 5—5, shown in FIG. 4.
Figure 6:
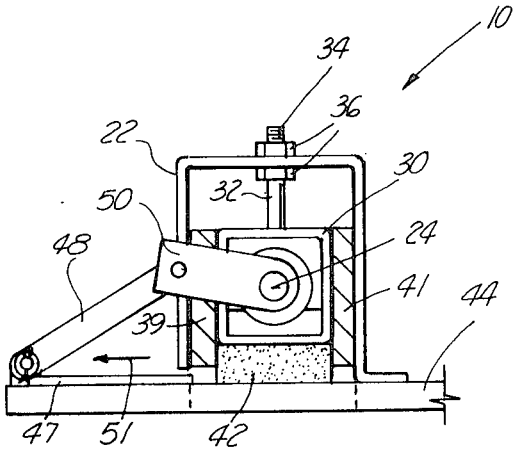
FIG. 6 illustrates a cover plate moved to the left away from the opening in the mounting plate and the sharpening stone lowered to engage the top of the feed sharpening knives for sharpening the knives.
Figure 7:
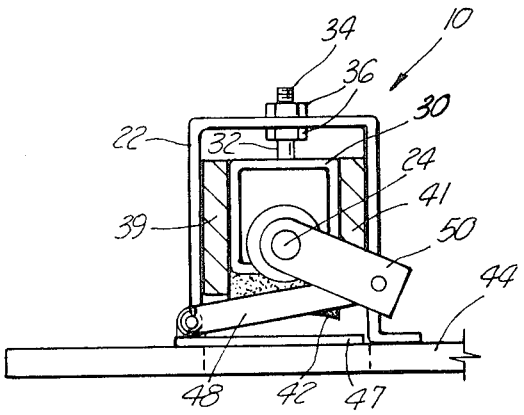
FIG. 7 illustates the cover plate in a closed position covering the opening and the stone in a raised position.

In FIG. 5 an end sectional view taken along lines 5—5 shows a cover plate 47 which is connected to a connecting link 48 attached to a lever arm 50 and slidably mounted on top of the mounting plate 44. Referring now to both FIGS. 6 and 7, there are a pair of lever arm 50 attached to both ends of the shaft 24 with the arms 50 connected to a pair of links 48. As the cam 28 is rotated by the stone holder shaft 24, the links 48 urge the cover plate 47 to the left as indicated by arrow 51 and away from the opening 46 as the stone 42 is lowered. This is shown in FIG. 6. As the stone 42 is lowered by the cam 28 at the same time the cover plate 47 exposes the opening 46 so the stone 42 can be lowered through the opening for engaging and sharpening the knives 12.

When the motor 16 is reversed, the cam 28 again engages the stoneholder 30, raising the stone 22 at the same time. The stoneholder shaft 24 rotates the lever arm 50 and links 48 thereby sliding the cover plate 47 back to its original position covering the opening 46 and thereby protecting the bottom of the stone 42 from any foreign object being discharged from the feed chopping box which houses the knives 12 and closes the chopping cylinder.

From reviewing the above drawings, it can be seen by actuating the drive motor 16, the sharpening stone 42 can be automatically lowered through the opening 46 in the mounting plate 44 as the opening 46 is uncovered by the cover plate 47. When the knives 12 have been sharpened and without stopping the feed chopping operation, the motor 16 is reversed with the stone 42 and holder 30 rased back into the sharpener housing 22 and at the same time the opening 46 is again closed to protect the motor driven feed sharpener 10 and to keep chopped feed from exiting through opening 46.

Changes may be made in the construction and arrangement of the parts or elements of the embodiments as described herein without departing from the spirit or scope of the invention defined in the following claims.

What is claimed is:

1. A motor driven feed sharpener for sharpening feed chopping knives and the like mounted on a feed chopper, the sharpener comprising:

a drive motor connected to a drive shaft, the motor mounted on a sharpener housing;

a stoneholder shaft connected to the drive shaft and rotated thereby, the stoneholder shaft extending along the length of the top of the stoneholder and having a cam mounted thereon;

a tubular stoneholder slidably mounted in the sharpener housing, the stoneholder having an elongated sharpening stone mounted on the bottom thereof, the cam disposed inside the stoneholder and engaging the stoneholder for raising and lowering the holder in the sharpener housing; and a mounting plate disposed above the feed chopping knives, the mounting plate receiving the sharpener housing thereon, the mounting plate having an elongated opening therein for receiving the bottom of the stone when the stoneholder is lowered by the cam.

2. The sharpener as described in claim 1 further including a cover plate slidably mounted on top of the mounting plate and connected to the stoneholder shaft, as the shaft is rotated, the cover plate is moved away from the opening as the stone is lowered, as the stone is raised, the cover plate is moved toward the opening for covering the opening when the stone reaches its raised height in the sharpener housing.

3. The sharpener as described in claim 2 wherein the cover plate is connected to the stoneholder shaft by a lever arm attached to a connecting link.

4. The sharpener as described in claim 1 wherein the drive shaft is connected to the stoneholder shaft by an endless chain.

5. The sharpener as described in claim 1 wherein the stoneholder is slidably mounted in the sharpener housing by a plurality of depth adjusting bolts.

6. A motor driven feed sharpener for sharpening feed chopping knives and the like mounted on a feed chopper, the sharpener comprising:

a drive motor connected to a drive shaft, the motor mounted on a sharpener housing;

a stoneholder shaft connected to the drive shaft by an endless chain and rotated thereby;

a tubular stoneholder slidably mounted in the sharpener housing, the stoneholder having an elongated sharpening stone mounted on the bottom thereof, the stoneholder shaft extending through the tubular stoneholder, the shaft having at least one cam mounted thereon and engaging the stoneholder for raising and lowering the stoneholder in the sharpener housing;

a mounting plate disposed above the feed chopping knives, the mounting plate receiving the sharpener housing thereon, the mounting plate having an elongated opening therein for receiving the bottom of the stone when the stoneholder is lowered in the sharpener housing; and a cover plate slidably mounted on top of the mounting plate and connected to the stoneholder shaft by a lever arm connected to one end of the stoneholder shaft, the lever arm connected to a connecting link, the connecting link connected to the cover plate, the cover plate moved away from the opening as the stone is lowered, as the stone is raised, the cover plate is moved toward the opening for covering the opening when the stone reaches its raised height in the sharpener housing.

* * * * *